US008528488B2

(12) United States Patent
Stiedl

(10) Patent No.: US 8,528,488 B2
(45) Date of Patent: Sep. 10, 2013

(54) UNDERCARRIAGE CROSS MEMBER FOR A RAIL VEHICLE

(75) Inventor: Hans Stiedl, Rheinberg (DE)

(73) Assignee: Siemens Aktiengesellschaft, Munich (DE)

( * ) Notice: Subject to any disclaimer, the term of this patent is extended or adjusted under 35 U.S.C. 154(b) by 68 days.

(21) Appl. No.: 12/866,962

(22) PCT Filed: Feb. 2, 2009

(86) PCT No.: PCT/EP2009/051122

§ 371 (c)(1),
(2), (4) Date: Aug. 10, 2010

(87) PCT Pub. No.: WO2009/100992

PCT Pub. Date: Aug. 20, 2009

(65) Prior Publication Data

US 2011/0005424 A1 Jan. 13, 2011

(30) Foreign Application Priority Data

Feb. 12, 2008 (DE) ..... 10 2008 008 681

(51) Int. Cl.
*B61D 1/00* (2006.01)

(52) U.S. Cl.
USPC ..... 105/157.1; 105/199.3; 105/226

(58) Field of Classification Search
USPC ..... 105/157.1, 163.1, 163.2, 166, 167, 105/172, 182.1, 184, 196, 199.1, 200, 202, 105/204, 208, 208.1, 208.2, 226, 227, 229
See application file for complete search history.

(56) References Cited

U.S. PATENT DOCUMENTS

| | | | | |
|---|---|---|---|---|
| 3,913,495 | A * | 10/1975 | Pelabon | 105/199.3 |
| 4,294,175 | A * | 10/1981 | Harsy | 105/199.3 |
| 5,775,231 | A * | 7/1998 | Kammerhofer et al. | 105/413 |
| 6,279,488 | B1 * | 8/2001 | Hachmann et al. | 105/453 |
| 6,360,674 | B1 * | 3/2002 | Schuller et al. | 105/199.3 |
| 2011/0005424 | A1 * | 1/2011 | Stiedl | 105/157.1 |

FOREIGN PATENT DOCUMENTS

| | | |
|---|---|---|
| DE | 1778439 U | 5/1959 |
| DE | 103 01 911 | 9/2004 |
| DE | 10 2008 004 871 | 7/2009 |
| DE | 10 2008 009 973 | 8/2009 |
| EP | 0 775 621 | 5/1997 |
| EP | 0775621 A1 | 5/1997 |
| EP | 1 557 337 | 7/2005 |
| EP | 1557337 A1 * | 7/2005 |
| EP | 1 972 255 | 9/2008 |
| WO | WO 94/07734 | 4/1994 |
| WO | WO 01/36245 | 5/2001 |

OTHER PUBLICATIONS

International Search Report.
Office Action for German patent application No. 10-2008-008-681.9 dated Jul. 16, 2010.
Office Action for corresponding Russian patent application No. 2010137840/11 dated Jan. 28, 2013.

* cited by examiner

*Primary Examiner* — Jason C Smith
(74) *Attorney, Agent, or Firm* — Harness, Dickey & Pierce, P.L.C.

(57) ABSTRACT

An undercarriage cross member is disclosed for a rail vehicle. In at least one embodiment, the cross member is constructed solely from aluminum extruded sections.

8 Claims, 1 Drawing Sheet

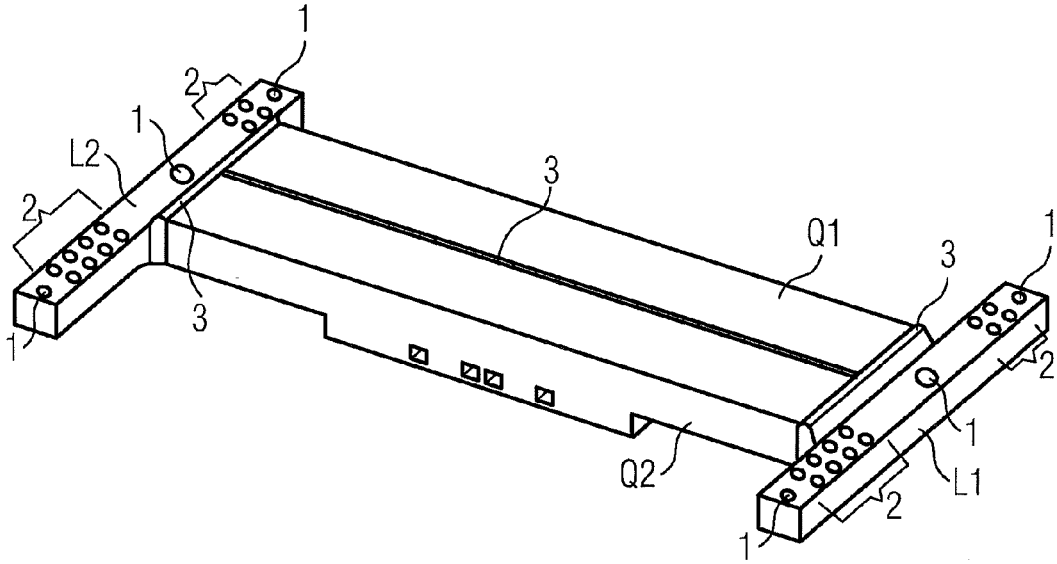
1
2
1
L2
2
3
3
1
Q1
3
1
2
1
L1
Q2
2
1

UNDERCARRIAGE CROSS MEMBER FOR A RAIL VEHICLE

PRIORITY STATEMENT

This application is the national phase under 35 U.S.C. §371 of PCT International Application No. PCT/EP2009/051122 which has an International filing date of Feb. 2, 2009, which designates the United States of America, and which claims priority on German patent application number DE 10 2008 008 681.9 filed Feb. 12, 2008, the entire contents of each of which are hereby incorporated herein by reference.

FIELD

At least one embodiment of the invention generally relates to an undercarriage cross member for a rail vehicle.

BACKGROUND

Known undercarriage cross members for rail vehicles which are manufactured from the material "aluminum" are cast parts. The manufacture of cast parts is known to be comparatively expensive and complex.

SUMMARY

At least one embodiment of the invention therefore specifies an undercarriage cross member which permits more favorable fabrication while retaining the material "aluminum".

At least one embodiment specifies that the undercarriage cross member is constructed exclusively from aluminum extruded profiles.

The manufacture of extruded profiles is generally more cost-effective than that of cast parts. For this reason, advantages are obtained through the use of extruded profiles.

The undercarriage cross member can have attachment points for attaching the undercarriage cross member to longitudinal carriers of a wagon body, in which case the undercarriage cross member preferably has no further attachment points to the wagon body.

It is also possible for there to be further attachment points for undercarriage elements which are selected from the group which comprises an anti-roll device, dampers and stops. This makes it possible to attach typical undercarriage elements to the undercarriage cross member.

The undercarriage cross member can have a generally H-shaped structure. In this context it is preferred that the H-shaped structure is formed from two transverse profiles, which are arranged parallel to one another, and two longitudinal profiles, wherein the transverse profiles are each connected by their end sides to both longitudinal profiles. The two extruded profiles which are arranged parallel to one another are expediently also connected to one another. The necessary connections are preferably established by means of welding.

In this context, welding seams which are provided between the extruded profiles can be hot-age-hardened.

BRIEF DESCRIPTION OF THE DRAWINGS

An example embodiment of the invention will be explained in more detail below with reference to the drawing.

The single FIGURE shows a perspective view of an undercarriage cross member for a rail vehicle.

DETAILED DESCRIPTION OF THE EXAMPLE EMBODIMENTS

The undercarriage cross member which is illustrated in the FIGURE is constructed from four extruded profiles, specifically in such a way that a generally H-shaped structure is produced. With reference to the H-structure, two transverse profiles Q1, Q2 are provided which run parallel one next to the other and are connected to one another by means of a welding seam 3 which runs between them. Ends of the transverse profiles Q1, Q2 abut against a right-hand longitudinal profile L1 and a left-hand longitudinal profile L2. End sides of the transverse profiles Q1, Q2 are attached to the longitudinal profiles L, L2 using welding seams 3. All the welding seams 3 are hot-age-hardened, which leads to an increase in the strength of the seams.

Both longitudinal profiles L1, L2 are provided with attachment points 1, 2 which have the following functions. The attachment points 1 have in common the fact that they permit a connection to a longitudinal carrier of a wagon body which interacts with the undercarriage cross member. The attachment points 1 are provided at respective ends of the longitudinal profiles L1, L2 and approximately in the center thereof. The attachment points 1 form the only attachment connection between the undercarriage cross member and the wagon body.

The attachment points 2 serve for the mounting of undercarriage elements such as an anti-roll device, one or more dampers of stops (not all are illustrated). The attachment points 2 are to be arranged on the longitudinal profiles L1, L2 in a way which is required by a general configuration of the associated undercarriage. In the illustrated exemplary embodiment, the attachment points 2 are each located at a small distance inward from the outer attachment points 1.

It is to be emphasized that in other embodiments of the invention more than two transverse profiles or else just a single transverse profile can also be provided. Modifications in terms of the embodiment of the longitudinal profiles are also conceivable.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An undercarriage cross member arranged between a bogie and a wagon body of a rail vehicle, the undercarriage cross member comprising:

a pair of parallel transverse profiles; and a longitudinal profile attached at opposite ends of the pair of parallel transverse profiles, wherein said undercarriage cross member is constructed exclusively of aluminum extruded profiles, and said undercarriage cross member includes first attachment points located at least at distal ends of each of the longitudinal profiles, the first attachment points being configured to attach the undercarriage cross member directly to the wagon body of the rail vehicle.

2. The undercarriage cross member as claimed in claim 1, wherein said undercarriage cross member has no further attachment points to the wagon body.

3. The undercarriage cross member as claimed in claim 1, wherein said undercarriage cross member includes second attachment points for undercarriage elements which are selected from the group which comprises an anti-roll device, dampers and stops.

4. The undercarriage cross member as claimed in claim 3, wherein the second attachment points are formed as through holes in a portion of the longitudinal profiles.

5. The undercarriage cross member as claimed in claim 1, wherein said undercarriage cross member includes a generally H-shaped structure.

6. The undercarriage cross member as claimed in claim 5, wherein the H-shaped structure is formed from the pair of transverse profiles, which are arranged parallel to one another, and the longitudinal profiles, wherein the transverse profiles are each connected by their end sides to both of the longitudinal profiles.

7. The undercarriage cross member as claimed in claim 1, wherein welding seams, provided between the extruded profiles, are hot-age-hardened.

8. The undercarriage cross member as claimed in claim 1, wherein the first attachment points are formed as through holes in a portion of the longitudinal profiles.

* * * * *